United States Patent [19]

Kando

[11] Patent Number: 4,752,801

[45] Date of Patent: Jun. 21, 1988

[54] ELECTROPHOTOGRAPHIC PRINTER HAVING OPENABLE DISCHARGE PORT FORMED BY DISPLACABLE FUSER ROLLER

[75] Inventor: Giichi Kando, Morioka, Japan

[73] Assignee: Alps Electric Co., Ltd., Japan

[21] Appl. No.: 11,025

[22] Filed: Feb. 5, 1987

[30] Foreign Application Priority Data

Apr. 22, 1986 [JP] Japan ..... 61-93093

[51] Int. Cl.[4] ..... G03G 15/00

[52] U.S. Cl. ..... 355/3 R; 355/3 FU; 355/3 SH

[58] Field of Search ..... 355/3 FU, 14 FU, 3 R, 355/3 SH; 219/216

[56] References Cited

U.S. PATENT DOCUMENTS

| | | | |
|---|---|---|---|
| 3,834,861 | 9/1974 | McCarroll | 219/216 X |
| 4,464,985 | 8/1984 | Asanuma et al. | 355/3 FU |
| 4,598,990 | 7/1986 | Kusumoto | 355/3 FU |

*Primary Examiner*—R. L. Moses

*Attorney, Agent, or Firm*—Guy W. Shoup

[57] ABSTRACT

An electrophotographic printer has first and second fixing rollers arranged near its discharge port for the recording paper. The discharge port has a stationary plate which is a part of the housing, and a movable plate which is movable toward and away from the stationary plate. One of the fixing rollers is mounted in a stationary position, and the other fixing roller is mounted on the movable plate. The movable plate is moved toward the stationary plate to form a port of normal width, and away from the stationary plate to open the port to allow jammed papers to be easily removed from inside the printer.

7 Claims, 1 Drawing Sheet

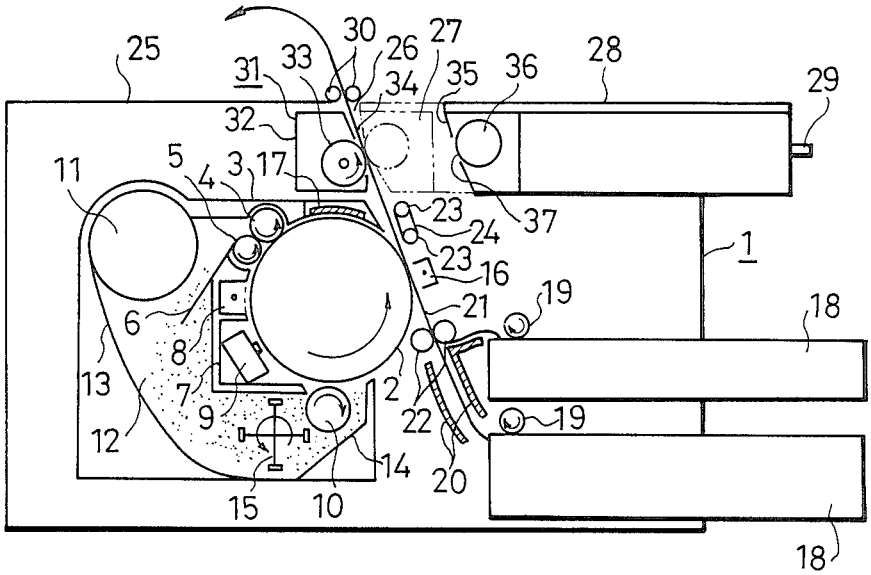
25
30
26
27
28
29
31
33
34
35
36
32
11
5
4
3
17
23
24
37
1
23
16
19
18
6
21
8
13
7
2
9
22
19
12
14
20
15
10
18

ELECTROPHOTOGRAPHIC PRINTER HAVING OPENABLE DISCHARGE PORT FORMED BY DISPLACABLE FUSER ROLLER

BACKGROUND OF THE INVENTION

1. Field of the Invention

The present invention relates to printers such as a printer for a computer, a printer of facsimile equipment, a laser printer, an LED printer, a liquid crystal printer, etc, and particularly to an electrophotographic printer for forming a visible image on a recording medium with a developer according to picture information by means of an electrophotographic system.

2. Description of the Prior Art

The electrophotographic system was employed for copy machines originally. In recent years, however, the electrophotographic system has come to be widely used also in picture output devices, that is, printers of the kind as described above, because of its high printing quality, high printing speed, and low noises.

In conventional electrophotographic printers, generally, an electrostatic latent image on a photosensitive body is made visible with a developer and the thus developed visible image is transferred from the photosensitive body onto recording medium such as recording paper. In a fixing device, thereafter, the recording paper carrying the thus transferred visible image is sandwiched between a pair of fixing rollers so that the visible image is fixed on the recording paper by means of heat and pressure. In such a conventional electrophotographic printer, however, there has been a possibility that the recording paper is jammed in the fixing device during transportation of the recording paper.

Upon occurrence of recording paper jamming during transportation of the recording paper in an electrophotographic printer as described above, conventionally, a side wall of a housing is fully opened to take out the jammed recording paper. In this case, there have been problems that such a work to fully open the side wall is troublesome and that external light may be radiated on a photosensitive body when the side wall is fully opened to thereby shorten the life of the photosensitive body. A further problem is that it is difficult to remove recording paper sandwiched between a pair of fixing rollers of a fixing device even if the side wall is fully opened and there is a risk of damage of the recording paper unless the paper is taken out with skill.

SUMMARY OF THE INVENTION

It is therefore an object to eliminate the above-mentioned disadvantages in the prior art.

It is another object of the present invention is to provide an electrophotographic printer in which recording paper jammed in a fixing device can be removed by a simple operation without fully opening a side wall of a housing, in which no external light is radiated on a photosensitive body when the recording paper is removed, and the recording paper is not broken.

In order to attain the above-mentioned objects, according to as aspect of the present invention, the electrophotographic printer comprises: a housing for enclosing therein a photosensitive body, a developing device for making an electrostatic latent image formed on the photosensitive body visible with toner, a transfer device for transferring the visible image onto a recording medium from the photosensitive body, a fixing device provided with first and second fixing rollers for fixing the visible image on the recording medium; an exhaust port formed at a portion of the housing for externally discharging the recording medium carrying the fixed visible image; at least two plate members disposed on the housing for forming the exhaust port therebetween, one of the plate members being arranged stationarily on the housing, the other plate member being arranged to be movable toward and away from the one plate member between a first and a second position so that the exhaust port has a normal width between the two plate members when the other plate member is in the first position while the exhaust port is widened when the other plate member is moved into the second position; the first fixing roller being supported on the other plate member so as to be movable together with the other plate member so that the first fixing roller is urged against the second fixing roller when the other plate member is in the first position while separated from the second fixing roller when the other plate member is brought into the second position.

Preferably, the exhaust port is formed at a top portion of the housing.

Preferably, the housing has an upper wall portion and an opening formed in the upper wall portion, and in which the one plate member is a part of the upper wall portion of the housing and the other plate member is arranged to substantially cover the opening.

Preferably, the other plate member is arranged to be manually movable between the first and second positions.

Preferably, the exhaust port is widened to an extent that the fixing rollers are accessible by hand of an operator through the widened exhaust port when the other plate member is brought into the second position.

Preferably, the fixing means is disposed at a position directly above the photosensitive body so as to substantially prevent external light from radiating on the photosensitive body even in the case where the other plate member is brought into the second position to widen the exhaust port.

Preferably, the first and second fixing rollers are a heat roller and a pressing roller respectively, or a pressing roller and a heat roller respectively.

According to the present invention, as described above, when the other, or the movable plate member defining a part of the exhaust port is moved so as to go away from the one plate member, that is, a part of the upper wall portion of the housing, the second fixing roller of the fixing device moves together with the other plate member so as to go away from the first fixing roller to widen the exhaust port so that when recording paper is jammed in the fixing device the jammed recording paper existing at a gap between the pair of first and second fixing rollers which are now separated from each other can be taken out through the widened exhaust port easily, with no risk of damage of the recording paper on one hand, and with no risk that the photosensitive drum is irradiated with external light on the other hand because the exhaust port is not so widely opened.

Other features and advantages of the invention will be apparent from the following description taken in connection with the accompanying drawing.

BRIEF DESCRIPTION OF THE DRAWING

A single drawing is a front view in section showing an embodiment of the electrophotographic printer according to the present invention.

DESCRIPTION OF PREFERRED EMBODIMENT

Referring to a single FIGURE of drawing, a preferred embodiment of the present invention will be described hereunder.

In an electrophotographic printer, a photosensitive body such as, for example, a photosensitive drum 2 is provided in a housing 1 so as to be rotatable in the direction of arrow, and a casing 3 is provided at the left side of the photosensitive drum 2 in the housing 1 so as to cover the photosensitive drum 2 from the upper portion to the lower portion thereof. At an internal upper portion of the casing 3, a sponge roll 4 for removing residual toner on the photosensitive drum 2 is provided so as to be rotatable in the direction while contacting with the photosensitive drum 2. A magnet roll 5 supported to be rotatable in the direction of arrow is made to contact with the sponge roll 4 so that toner attached on the photosensitive drum 2 is attracted to the magnet roll 5. A blade 6 is provided in the vicinity of the magnet roll 5 and urged against the magnet roll 5 so that toner T attracted on the magnet roll 5 is scraped from the magnet roll 5 by the blade 6.

A frame 7 is provided in the casing 3 at a vertically central position adjacent to the photosensitive drum 2, and a charging device 8 for giving electrostatic charges to the photosensitive drum 2 from which the toner T was removed by the sponge roll 4 and an optically write-in member 9 such as an LED head for forming a latent image on the photosensitive drum 2 charged to a predetermined potential by the charging device 8 are attached on the frame 7. A developing sleeve 10 for causing toner T to attach onto the photosensitive drum 2 is provided in the housing 1 at a position directly under the photosensitive drum 2.

A toner cartridge 11 is removably loaded in the casing 3 at an internal upper portion thereof, and a moving path 12 is defined by a rear surface of the frame 7 and a guide plate 13 disposed in the casing 3 so that the toner T in the toner cartridge 11 and the toner T removed from the magnet roll 5 may move through this moving path 12. The guide plate 13 is slantingly provided so as to be somewhat curved down from the vicinity of the toner cartridge 11, and another guide plate for preventing toner T of no use from existing is slantingly provided in the casing 3 at a position directly under the developing sleeve 10. Further, a stirrer 15 for stirring unused toner T and reused toner T so as to mix both the toner T with each other is provided in the casing 3 at an inner lower portion thereof adjacent to the developing sleeve 10.

A transfer device 16 for transferring an image made visible with toner T on the photosensitive drum 2 to a recording body such as, for example, recording paper is provided in the housing 1 and at the right side of the photosensitive drum 2, and a discharging device 17 for removing residual charges on the photosensitive drum 2 is provided in the housing 1 at a position above the photosensitive drum 2.

Two paper feed cassettes 18 and 18 vertically separated from each other are provided in the housing 1 at an internal lower portion thereof, and hopping rollers 19 and 19 for feeding recording paper sheet by sheet out of the respective paper feed cassettes 18 are provided also in the housing 1. Paper guides 20, 20, . . . for directing recording paper fed out of either one of the paper feed cassettes 18 toward the photosensitive drum 2 are provided in the housing 1, and a transport path 21 provided with transporting rollers 22 and 22 for transporting recording paper is formed at the end portions of the respective paper guides 20 so as to cause the recording paper to pass between the photosensitive drum 2 and transfer device 16. The transport path 21 is arranged to transport recording paper slantwise upwards. Further, conveyer means constituted by a belt 24 would around a pair of pulleys 23 and 23 is provided in the transport path 21 at a position downward and transfer device 16.

An exhaust port 26 is formed in an upper wall 25 of the housing 1 at an extension of the transport path 21. The exhaust port 26 is constituted by a gap between the upper wall 25 and a movable box-like plate member 28 capable of covering an upper opening formed in the upper wall 25. The movable box-like plate member 28 is arranged to be movable horizontally between two positions, that is, a first and a second position, shown in the drawing with imaginary and solid lines respectively. Thus, the exhaust port 26 is in its normal state when the movable box-like plate member 28 in the first position shown by the imaginary line where the movable box-like plate member 28 is close to the opposite side surface of a plate member constituting the upper wall 25.

A pair of exhaust rollers 30 and 30 are supported on the upper wall 25 of the housing 1. A fixing device 31 for fixing a visible image on recording paper onto the same recording paper by means of heat and pressure is provided directly under the upper wall 2, so that the recording paper passed by the fixing device 31 is externally discharged by the exhaust rollers 30 and 30. The fixing device 31 is constituted by a pair of casing 32 and 35 and a pair of fixing rollers such as, for example, a heat roller 33 and a pressing roller 36 supported within the casings 32 and 35 respectively. The one casing 32 of the fixing device 31 is attached on the upper wall 25, while the other casing 35 of the fixing device 31 is attached on the movable box-like plate member 28 at a position so as to be in opposition to the one casing 32. The heat roller 33 is internally provided with a heating member such as a heater and arranged so that the periphery of the heat roller 33 partly faces the inside of the transport path 21 through an opening 34 formed in the casing 32. On the other hand, the pressing roller 36 is arranged so that the periphery of the pressing roller 36 partly faces the inside of the transport path 21 through an opening 37 formed in the casing 35 to thereby press the heat roller 33 similarly facing the inside of the transport path 21 when the exhaust port 26 is in its normal use state, that is, when the movable box-like plate member 28 is brought into its first position shown by the imaginary line in the drawing. Alternatively, the pressing roller 36 may be stationarily supported with the heat roller 33 attached on the movable box-like plate member 28 so that the heat roller 33 per se is moved together with the movable box-like plate member 28.

Next, the operation of the embodiment will be described hereunder.

First, the photosensitive drum 2 is corona charged to a predetermined potential by the charging device 8 supported on the frame 7 in the casing 3, and, immediately, a latent image corresponding to picture information is formed onto the charged photosensitive drum 2 by the optically writing member 9 disposed at a position adjacent to the charging device 8. Then, the toner T is caused to be attracted and attached onto the photosensitive drum 2 by the developing sleeve 10 disposed at a position adjacent to the optically writing member 9 so as to form a visible image with the toner T on the photosensitive drum 2 corresponding to the latent image.

On the other hand, when recording paper fed into the transport path 21 from either one of the paper feed cassettes 18 by the associated hopping roller 19 is transported by the transporting rollers 22 and 22 to reach the gap between the photosensitive drum 2 and the transfer device 16, the image made visible with toner T on the photosensitive drum 2 is transferred onto the recording paper by means of corona discharge by the transfer device 16, and the recording paper carrying the transferred visible image is transported slantwise upwards by the conveyer belt 24 through transport path 21. When passed through the fixing device 31, the recording paper is sandwiched between the heat roller 33 and the pressing roller 36 so that the visible image with toner T is fixed on the recording paper by means of heat and pressure given by the heat and pressing rollers 33 and 36 respectively. Then, the recording heat is discharged by the exhaust rollers 30 and 30 onto the upper wall 25 of the housing 1 through the exhaust port 26 of the upper wall 25.

On the other hand, the residual potential of the photosensitive drum 2 in the position where the visible image has been transferred therefrom onto the recording paper by the transfer device 16 as described above is removed by means of light emitted from the discharging device 17, and then the residual toner T on the photosensitive drum 2 is removed by the sponge roll 4 to complete one cycle. The toner T absorbed into the sponge roll 4 is attracted onto the magnet roll 5, and then scraped by the blade 6 urged against the magnet roll 5, the scraped toner T falling down into the moving path 12. The toner T fallen down into the moving path 12 is then mixed by the stirrer 15 with new toner T fed from the toner cartridge 11 so as to be used again. Upon occurrence of jamming of recording paper in the fixing device 31, the movable box-like plate member 28 is taken by the hand at a handle 29 and pulled right in the drawing. The exhaust port 26 is widened and the pressing roller 36 goes away from the heat roller 33 at the same time, so that it is made possible to take out the recording paper jammed in the fixing device 31 by the hand entered through the widened exhaust port 26 simply and without risk of damage of the recording paper. Further, there is no risk that the photosensitive drum 2 is irradiated with external light because the widened state of the exhaust port 26 is not so large and the upper portion of the photosensitive drum 2 is covered with the discharging device 17. Upon completion of the work of removal of the recording paper, the movable box-like plate member 28 is moved left in the drawing to make the exhaust port 26 narrow to its normal width so that the pressure roller 36 is urged against the heat roller 33.

Thus, according to the present invention, even if recording paper is jammed in the fixing device 31 the jammed recording paper can be easily taken out with no risk that the photosensitive drum 2 is irradiated with external light during the recording paper removing work. Further, according to the embodiment, the printing efficiency is good because one cycle of printing is completed by one revolution of the photosensitive drum 2, and the residual toner T on the photosensitive drum 2 can be economically used again. Further, it is possible to shorten the transport path 21 for recording paper and to reduce the frequency of occurrence of recording paper jamming to thereby improve the reliability. Furthermore, heat radiating efficiency is good and does not affect the photosensitive drum 2 even if no heat-proof structure is provided on the other members such as the photosensitive drum 2, etc., because the fixing device 31 is disposed at the internal upper end portion of the housing 1 so that the heat of the fixing device 31 can be externally radiated through the upper wall 25 of the housing 1.

(Effects of the Invention)

As described above, according to the present invention, there are such effects that even if recording paper is jammed in the fixing device the recording paper can be simply removed without being broken, and during the recording paper removing work the photosensitive drum is not irradiated with external light so that there is no risk of shortening life of the photosensitive drum 2.

What is claimed is:

1. An electrophotographic printer comprising:

a housing for enclosing therein a photosensitive body, means for forming an electrostatic latent image on said photosensitive body, developer means for making the latent image on said photosensitive body visible with toner, transfer means for transferring the visible image onto a recording medium from said photosensitive body, fixing means provided with a first and a second fixing rollers for fixing the visible image on said recording medium when said recording medium is brought between said first and second fixing rollers;

an exhaust port formed at a portion of said housing for externally discharging therethrough the recording medium carrying a fixed visible image thereon;

at least two plate members disposed on said housing for forming said exhaust port therebetween, one of said plate members being arranged stationarily on said housing, the other plate member being arranged to be movable toward and away from said one plate member between a first and a second position so that said exhaust port has a normal width between said one and the other plate members when said other plate member is in said first position, while said exhaust port is widened when said other plate member is moved into said second position;

said housing having an upper wall portion and an opening formed in said upper wall portion, wherein said one plate member is a part of said upper wall portion of said housing and the other plate member is arranged to substantially cover said opening when it is moved to said first position; and said first fixing roller being supported on said other plate member so as to be movable together with said other plate member so that said first fixing roller is urged against said second fixing roller when said other plate member is in said first position, while being separated from said second fixing roller when said other plate member is brought into said second position.

2. An electrophotographic printer according to claim 1, in which said exhaust port is formed at a top portion of said housing.

3. An electrophotographic printer according to claim 1, in which said other plate member is arranged to be manually movable between said first and second positions.

4. An electrophotographic printer according to claim 1, in which said exhaust port is widened to an extent that said fixing rollers are accessible through said widened exhaust port when said other plate member is brought into said second position.

5. An electrophotographic printer according to claim 1, in which said fixing means is disposed at a position directly above said photosensitive body so as to substantially prevent external light from radiating on said photosensitive body even in the case where said other plate member is brought into said second position to widen said exhaust port.

6. An electrophotographic printer according to claim 1, in which said first and second fixing rollers are a heat roller and a pressing roller respectively.

7. An electrophotographic printer according to claim 1, in which said first and second fixing rollers are a pressing roller and a heat roller respectively.

* * * * *